United States Patent [19]

Watson et al.

[11] 4,372,245

[45] Feb. 8, 1983

[54] DEVICE FOR COATING INTERNAL THREADS OF A FASTENER

[75] Inventors: Colin Watson, Stillorgan, Ireland; David J. Dunn, Twinsburg, Ohio

[73] Assignee: Loctite Corporation, Newington, Conn.

[21] Appl. No.: 243,517

[22] Filed: Mar. 13, 1981

[51] Int. Cl.[3] ..... B05C 7/00; B05C 5/02

[52] U.S. Cl. ..... 118/56; 118/105; 118/408; 118/409

[58] Field of Search ..... 118/56, 105, 408, 409

[56] References Cited

U.S. PATENT DOCUMENTS

| | | | |
|---|---|---|---|
| 2,098,857 | 11/1937 | Buckingham | 91/43 |
| 2,264,632 | 12/1941 | Gerlitzki | 91/43 |
| 2,760,585 | 12/1956 | Bergeron | 166/243 |
| 2,877,480 | 3/1959 | Warren | 15/127 |
| 2,941,500 | 6/1960 | Adams | 118/408 |
| 3,120,346 | 2/1964 | Willhoite | 239/215 |
| 3,416,492 | 12/1968 | Greenleaf | 118/620 |
| 3,601,291 | 8/1971 | Tessmer | 222/519 |
| 3,817,210 | 6/1974 | Greever | 118/408 |
| 3,956,533 | 5/1976 | Weber et al. | 427/236 |

*Primary Examiner*—James R. Hoffman

*Attorney, Agent, or Firm*—Watson, Cole, Grindle & Watson

[57] ABSTRACT

A device for coating the internal threads of a fastener includes a rotatable base for holding the fastener, and an applicator having a discharge orifice extending through its side wall which contacts the internal threads at a single point of tangency, the axis of the applicator being offset from the rotational axis of the base. Thus, an induced side load force is created at the point of tangency for effecting the pressing of discharged sealant into the roots of the threads. Differently sized internally threaded elements can be coated in accordance with the invention while using the same sealant applicator.

12 Claims, 5 Drawing Figures

DEVICE FOR COATING INTERNAL THREADS OF A FASTENER

BACKGROUND OF THE INVENTION

This invention relates generally to a technique for applying a sealant to the threads of a fastener for providing a fluid-tight seal when threadedly engaged with a mating threaded element, as well as a device for carrying out such technique. More particularly, this invention relates to such a method and device wherein the sealant is pressed into the thread roots of the element, and differently sized elements are capable of being coated without changing applicators.

Prior known techniques in the application of sealant, especially of the anaerobic adhesive type, to the threads of female threaded fasteners are beset with problems in failing to meet quality control standards such as the avoidance of air bubbles during the application process. Otherwise, it has been difficult to control the requisite quantity of sealant to be coated without giving a sloppy appearance and without applying more than as needed. On the other hand, known sealant applying and coating devices for threaded fasteners, while better suited for controlling the desired amount of sealant applied to the threads, are not without their shortcomings. Air bubbles quite often remain entrapped in the applied sealant, resulting in a weakened seal and/or lock between the coated fastener and its mating part. Besides, the nozzle or sealant applicator used in the application process must be replaced with an appropriately sized applicator each time a differently sized threaded element is to be coated.

Examples of these prior art devices are disclosed in U.S. Pat. No. 3,956,533 to Weber et al, Gebrauchsmuster 7930867.1, and in U.S. Pat. No. 3,416,492 to Greenleaf. In the Weber et al and German patents the applicator is in the form of a threaded plug which engages the threads of a female threaded element to be coated. With such a screw threading coating operation, however, the threads are either incompletely covered with sealant and/or formation of air bubbles is difficult to avoid because of the inability to press the sealant in place. Moreover, differently sized female threaded elements having differently sized threads require complementarily sized threaded applicators, and repeated use of the same threaded applicator for the same sized elements oftentimes results in an undue buildup of sealant on the applicator threads.

In the aforementioned Greenleaf patent, use of such a coating nozzle renders it impossible to precisely control the amount of product to be coated or to effect a pressing of the coating in place against the threads. And, other problems mentioned above are not avoided by this coating approach.

SUMMARY OF THE INVENTION

It is therefore an object of this invention to provide a method for coating the internal threads of the fastener, and a device for carrying out the method, in such a manner as to more precisely control the amount of applied sealant while being pressed intimately into the fastener threads to substantially avoid air bubble formation;

Another object of the invention is to provide such a method and device which requires but a single sealant applicator for the coating of differently sized threads of two differently sized threaded elements;

A further object of the present invention is to provide such a method and device wherein the internally threaded element is held on a rotatable base against relative transverse movement therewith, and a side force is induced during rotation to allow sealant to be pressed into the thread roots of the element while any excess sealant is wiped from the threads by the edge of a discharge orifice opening through a side wall of a sealant applicator;

A still further object of the invention is to provide such a method and device wherein the applicator has a smooth outer wall through which the discharge orifice opens, the applicator being so positioned that its central axis lies parallel to and offset in one direction from the rotational axis with the side wall contacting the crests of the threads, such force thereby being induced in such one direction;

A still further object of the invention is to provide such a method and device wherein the discharge orifice of the sealant applicator is elongated in the direction of the applicator axis for spanning a plurality of threads for the simultaneous coating of same during a single revolution;

A still further object of the present invention is to provide such a method and device wherein the base may be made of magnetic material for holding a ferromagnetic threaded element by magnetic attraction, or the base may be formed as a chuck element for holding the threaded element in place;

Other objects, advantages and novel features of the invention will become more apparent from the following detailed description of the invention when taken in conjunction with the accompanying drawing.

DETAILED DESCRIPTION OF THE INVENTION

Figure 1:
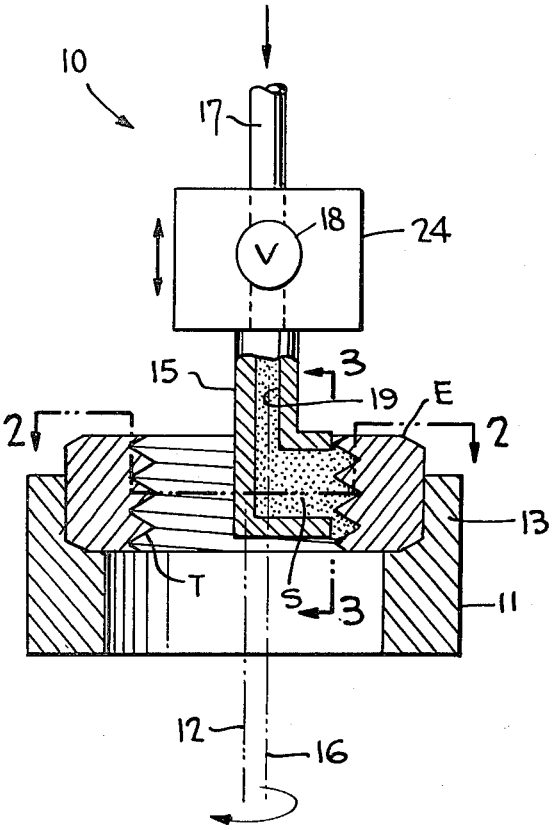
FIG. 1 is a side elevational view, partly in section, of the sealant applying device according to the invention.
Figure 2:
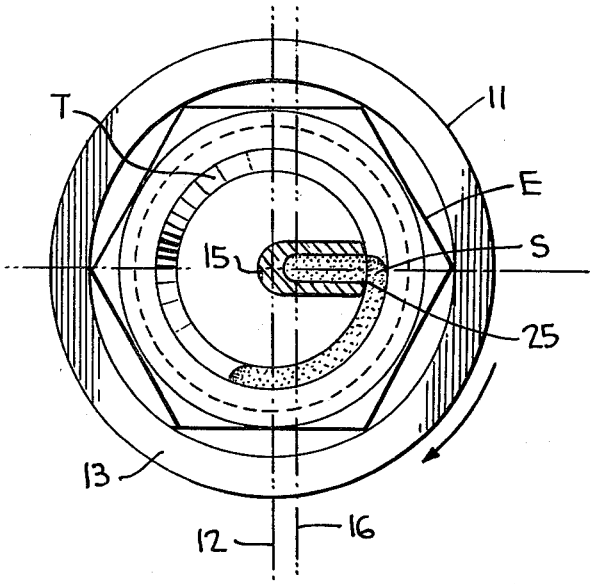
FIG. 2 is a sectional view of the sealant applicator and the threaded element to be coated, taken substantially along line 2—2 of FIG. 1.

Turning now to the drawing wherein like reference characters refer to like and corresponding parts throughout the several views, the sealant applying device is generally designated 10 in FIG. 1 and comprises a rotatable base 11 mounted in some suitable manner for rotation about its central axis 12 in a clockwise direction shown by the arrows of FIGS. 1 and 2. Conventional means (not shown) are provided for rotating the base in the illustrated direction, or in a counterclockwise direction without departing from the invention.

As a chuck a pilot 13 extends outwardly from the upper surface of the base into which an internally threaded element E, such as a nut fastener, is seated.

The pilot is sized so that its inner periphery locates snugly element E so as to prevent any relative transverse shifting of the threaded element during the sealant applying process. For a given inner diameter of element E, axis 16 of the sealant applicator will be offset relative to rotational axis 12 in either direction or will be coincident thereto. The base could also be magnetic for holding elements of ferromagnetic material. Further the base is hollow to prevent build up of sealant.

Figure 3:
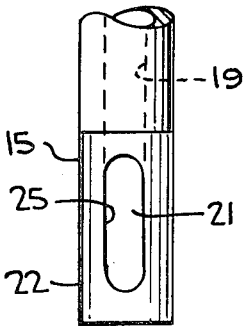
FIG. 3 is an elevational view of part of the sealant applicator and its discharge orifice, taken substantially along line 3—3 of FIG. 1.

A hollow sealant applicator 15 is mounted in any normal manner for movement along its central axis 16 in the directions illustrated by the double arrows in FIG. 1. The applicator is connected to a supply (not shown) of sealant S via a supply tube 17 having a discharge shut-off valve 18 associated therewith for opening and closing the flow of sealant from the supply. A hollow passageway 19 of the applicator communicates with supply tube 17 via valve 18 and terminates in a discharge orifice 21 (FIG. 3) located in a side wall 22 of the applicator which lies at a predetermined transverse distance from central axis 16. Side wall 22 has a smooth and unthreaded exterior as shown.

The sealant applicator is positioned relative to the rotatable base such that its central axis 16 lies parallel to and offset in one direction from central axis 12 with side wall 22 of the applicator in light contact engagement with the crests of internal threads T of the element to be coated (FIGS. 1 and 2).

The applicator is mounted in place for axial movement, as aforedescribed, in the direction of the double arrows of FIG. 1, but is otherwise incapable of rotary movement about its central axis 16. Base 11, on the other hand, is mounted in place for rotation about its central axis 12, and may be further mounted for axial movement toward and away from the applicator as an alternative to the mounting of the applicator for axial movement, so long as relative axial movement between the applicator and the base is facilitated. And, either the applicator or the base is mounted for transverse movement so as to assure the necessary relative transverse positioning between these parts.

Figure 4:
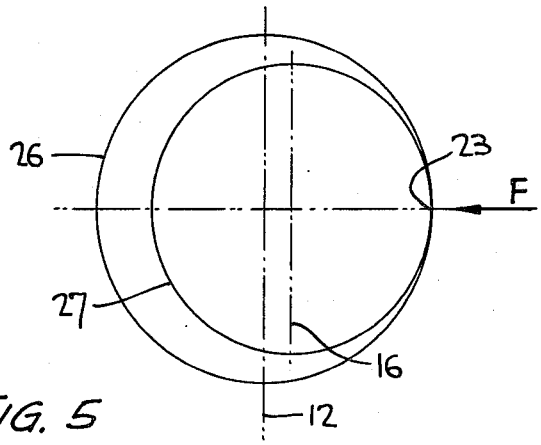
FIG. 4 is a schematic represenation showing the accentric path traced, during rotation of the base, by the point of tangency between the orifice wall of the applicator and the threads of the element to be coated.

In carrying out the sealant applying operation, the applicator will be spaced axially relative to the base a distance greater than the thickness of a threaded element E to be coated. A base 11 will be selected having an appropriately sized exterior locator substantially equal to the external nut shape of an element E to be coated. The applicator and base will then be shifted transversely relative to one another until side wall 22 is vertically aligned with the crests of threads T at a point of tangency 23 (FIG. 4). As will be described in more detail hereinafter, differently sized internally threaded elements are capable of being coated using the same applicator 15, so long as the offsetting relationship between axes 12 and 16 is maintained while side wall 22 touches the crests of the threads. Obviously, if this offsetting and side wall contacting relationship cannot be maintained for a particular internally threaded element, then a smaller sized applicator must be chosen.

Figure 5:
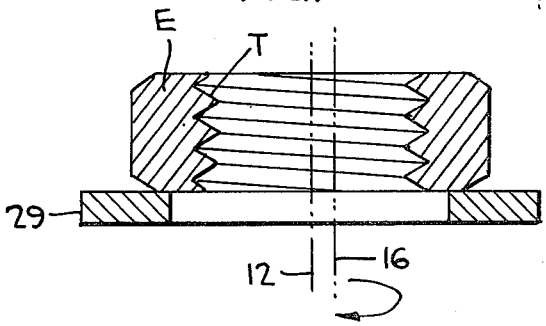
FIG. 5 is a view similar to FIG. 1, but without the applicator, of another holder base which may be provided for the threaded element.

While the applicator and base are relatively spaced in an axial direction, an element E is transferred by some suitable means and is seated on the rotatable base. If element E is of ferromagnetic material, it will be within locator 13 of a magnetic base 11 so as to be held firmly in place by magnetic attraction. Otherwise, if the element to be coated is of non-ferromagnetic material it will be seated within the jaws of a chuck 29 (FIG. 5), which will be described in more detail hereinafter.

Valve 18 remains in a closed position, and the applicator is operatively connected with an advance mechanism 24 so that, upon command, the applicator will be advanced into the threaded opening of element E seated on the base. When the applicator reaches its predetermined position of FIG. 1, sealant cut-off valve 18 is opened and sealant under pressure in line 17 flows through passage 19 and out of the elongated discharge orifice.

When valve 18 is opened, the means (not shown) provided for rotating the base is actuated for effecting clockwise movement relative to the stationary applicator. At the point of tangency 23, the discharged sealant under pressure is resisted by an induced force F (FIG. 4) acting in a direction aligned with the direction in which axis 16 is offset from axis 12. The snug engagement between the locator or magnetic base and element E facilitates this induced force. The discharge sealant is therefore pressed into the roots of threads T during rotation of the base, and an edge 25 of the discharge orifice (FIGS. 2 and 3) functions as a doctor blade wiping any excess sealant from the threads.

Valve 18 is operatively connected with an adjustable timing device (not shown) which is set for maintaining the valve open for an interval permitting the sealant to flow into the threads for at least one revolution of element E. When a sufficient amount of sealant has been applied to the threads, shut-off valve 18 will close and the applicator will be retracted from element E upon relative movement of the applicator and base away from one another. However, before retracting the applicator, after valve 18 is closed, the base may continue to be rotated if it is desired to smoothen the applied sealant as edge 25 of the discharge orifice wipes the threads.

With the arrangement and operation as aforedescribed, point of tangency 23 between side wall 22 and threads T traces a circular path 26 about axis 12 of the base which is eccentric relative to a circle 27 which is defined by the radial extent of side wall 22 from axis 16 of the applicator. Thus, it can be seen from the schematic illustration of FIG. 4 that a single point of tangency 23 is defined by the offsetting relationship of axes 12 and 16 so that force F is induced at only this point for effecting the pressing of discharged sealant in place without binding or interference between wall 22 and the threads which could otherwise occur if circles 26 and 27 were concentric.

FIGS. 1 and 4 illustrate locator 13 as having its central axis lying between axes 12 and 16 so as to define an eccentric circle 28 relative to 26 and 27. Such is for the purpose of illustration since the pilot, depending on its diameter, between axes 12 and 16, or to the left of axis 12 (when viewing FIGS. 1 and 4).

Thus, in order to accommodate internally threaded elements of sizes larger than that shown in the drawings relative to the size of the illustrated applicator, a base 11 having an appropriately sized locator will be selected and mounted in place prior to the coating operation. It can be therefore seen that, for pilot diameters larger than circle 27, point 23 of tangency will be maintained for the same relatively sized applicator with a force F induced for the purpose and in the manner aforedescribed.

For the coating of internally threaded elements which are non-ferromagnetic, locater 13 snugly embraced element E although axes 12 and 16 are offset for inducing a side load force F at a point of tangency 23 as described with reference to FIGS. 1 to 4. And, the chuck jaws holding element E vary in size for different chucks to accommodate differently sized elements to be coated.

From the foregoing, it can be seen that a simple and economical yet highly effective technique has been developed for the coating of internal threads of an element by pressing sealant firmly into the thread roots as a side force is induced at a point of tangency with the discharge orifice of an applicator, during rotation of that point of tangency eccentrically relative to the rotational axis of the base. The outer wall of the applicator through which the discharge orifice opens is smooth so as to avoid any undue buildup of sealant during repeated sealant applications. Also, this smooth exterior can accommodate differently sized internal threads of elements to be coated, without having to substitute specifically sized applicators as required by the prior art. Another advantage in the use of an applicator of the present type is that it better accommodates the preferred type of sealant which is in the form of an anaerobic adhesive enclosed with a mass of tiny crushable capsules in a viscous liquid carrier. With the provision of a smooth-walled applicator according to the invention, it is less likely that these capsules will prematurely crush during sealant discharge, rather than at the time the mating threaded element engages the coated threads. At such time, the capsules are crushed to release the adhesive after which it is able to cure in the absence of air.

Obviously many modifications and variations of the present invention are made possible in the light of the above teachings. It is therefore to be understood that within the scope of the appended claims that the invention may be practiced otherwise than as specifically described.

What is claimed is:

1. A device for applying a sealant to the threads of an element having a circular threaded opening, comprising a hollow sealant applicator having a central axis and a sealant discharge orifice lying at a predetermined radial distance from said axis, a rotatable base for holding the element and positioning same with its threads adjacent said orifice and for rotating the element about a central axis of the base lying parallel to and offset from said applicator axis, whereby a side force is induced in the direction of said discharge orifice during rotation of said base to effect a forced discharge of sealant from said orifice into the threads of the element.

2. The device according to claim 1, wherein said base is of magnetic material and has a locator piece on an upper surface thereof for holding and positioning the element, of ferromagnetic material, by magnetic attraction.

3. The device according to claim 1, wherein said base comprises a magnetic base for holding and positioning the element.

4. The device according to claim 1, wherein said base and said applicator are mounted for relative movement toward and away from one another along said axes respectively between operative and inoperative sealant applying positions.

5. The device according to claim 1, wherein said orifice is elongated in the direction of said applicator axis for spanning a plurality of element threads.

6. The device according to claim 5, wherein said orifice opens into a side wall of said applicator having a smooth outer surface, a side edge of said orifice defining a doctor blade for smoothening the sealant applied to the threads.

7. The device according to claim 1, wherein said orifice opens into a side wall of said applicator having a smooth exterior surface for avoiding any threaded engagement with the threads of the element.

8. A device for applying a sealant to the internal threads of a threaded element, comprising, means for holding the element and for positioning same for pressing the sealant under into the thread roots of the element, said holding means being rotatable about a central axis thereof, a sealant applicator having a discharge orifice opening through a smooth side wall thereof, and said applicator having a central axis spaced from said holding means axis a predetermined distance such that said side wall contacts the element threads, whereby a side force directed toward said orifice is induced during rotation of said holding means to facilitate the pressing of discharged sealant into the thread roots of the element while any excess sealant is wiped from the threads by an edge of said orifice.

9. The device according to claim 8, wherein said holding means comprises a base member of magnetic material having a locator piece on an upper surface thereof for holding and positioning the element, of ferromagnetic material, by magnetic attraction.

10. The device according to claim 8, wherein said holding means comprises a magnetic element for holding and positioning the element.

11. The device according to claim 8, wherein said holding means and said applicator are mounted for relative movement toward and away from one another along said axes respectively between operative and inoperative sealant applying positions.

12. The device according to claim 8, wherein said orifice is elongated in the direction of said applicator axis for spanning a plurality of element threads.

* * * * *